US010379567B2

(12) United States Patent
Sone

(10) Patent No.: US 10,379,567 B2
(45) Date of Patent: Aug. 13, 2019

(54) BANDGAP REFERENCE CIRCUITRY

(71) Applicant: SYNAPTICS INCORPORATED, San Jose, CA (US)

(72) Inventor: Yasuhiko Sone, Tokyo (JP)

(73) Assignee: SYNAPTICS INCORPORATED, San Jose, CA (US)

( * ) Notice: Subject to any disclaimer, the term of this patent is extended or adjusted under 35 U.S.C. 154(b) by 0 days.

(21) Appl. No.: 16/173,814

(22) Filed: Oct. 29, 2018

(65) Prior Publication Data

US 2019/0129461 A1 May 2, 2019

(30) Foreign Application Priority Data

Oct. 31, 2017 (JP) ..... 2017-211132

(51) Int. Cl.

| | |
|---|---|
| ***G05F 3/26*** | (2006.01) |
| ***G05F 3/24*** | (2006.01) |
| ***G05F 3/22*** | (2006.01) |

(52) U.S. Cl.

CPC ..... *G05F 3/267* (2013.01); *G05F 3/225* (2013.01); *G05F 3/245* (2013.01)

(58) Field of Classification Search

CPC ..... G05F 3/00; G05F 3/10; G05F 3/16; G05F 3/20; G05F 3/205; G05F 3/22; G05F 3/227; G05F 3/24; G05F 3/247; G05F 3/26; G05F 3/262; G05F 3/265; G05F 3/267

See application file for complete search history.

(56) References Cited

U.S. PATENT DOCUMENTS

| | | | | |
|---|---|---|---|---|
| 7,834,610 | B2 * | 11/2010 | Peng | G05F 3/30 323/313 |
| 8,836,315 | B2 * | 9/2014 | Satoh | G05F 3/30 323/316 |
| 2008/0106247 | A1 * | 5/2008 | Gheorghiu | G05F 3/262 323/316 |

OTHER PUBLICATIONS

H. Banba et al., "A CMOS Bandgap Reference Circuit with Sub-1-V Operation", IEEE Journal of Solid-state Circuits, vol. 34, pp. 670-674, May 1999.

Yuichi Okuda et al., "A Trimming-Free Cmos Bandgap-Reference Circuit with Sub-1-V-Supply Voltage Operation", 2007 Symposium on VLSI Circuits Digest of Technical Papers, pp. 96-97.

* cited by examiner

*Primary Examiner* — Gary L Laxton

(74) *Attorney, Agent, or Firm* — Patterson + Sheridan, LLP

(57) ABSTRACT

Bandgap reference circuitry comprises a first current mirror connected to a power supply line and configured to supply a first current to a first node and a second current to a second node virtually-shorted to the first node, a first pn junction element between the first node and a ground line; a first variable resistor element between the second node and the ground line, and a second pn junction element connected in series to the first variable resistor element. The first variable resistor element has a resistance dependent on a power supply voltage supplied to the power supply line.

20 Claims, 14 Drawing Sheets

BANDGAP REFERENCE CIRCUITRY

CROSS REFERENCE

This application claims priority to Japanese Patent Application No. 2017-211132, filed on Oct. 31, 2017, the disclosure of which is incorporated herein by reference in its entirety.

TECHNICAL FIELD

The present disclosure relates to bandgap reference circuitry.

BACKGROUND

Bandgap reference circuitry, which makes use of the temperature dependence of the current-voltage property of a pn junction to generate an output voltage stable against the temperature, is widely used for semiconductor integrated circuits.

In general, the output voltage of bandgap reference circuitry is considerably stable against disturbance; however, the output voltage may be slightly dependent on the power supply voltage, depending on the configuration of the bandgap reference circuitry.

SUMMARY

In one or more embodiments, bandgap reference circuitry comprises a current mirror connected to a power supply line and configured to supply a first current to a first node and supply a second current to a second node virtually-shorted to the first node, a first pn junction element between the first node and a ground line, a variable resistor element between the second node and the ground line, and a second pn junction element connected in series to the variable resistor element. The variable resistor element has a resistance dependent on a power supply voltage supplied to the power supply line.

In one or more embodiments, bandgap reference circuitry comprises a variable resistor element having a resistance dependent on a power supply voltage supplied to a power supply line, a current mirror connected to the power supply line, a first pn junction element between the first node and a ground line, a second pn junction element between the second node and the ground line, and a first resistor element connected in series to the second pn junction. The current mirror is configured to supply a first current to a first node and supply a second current to a second node virtually-shorted to the first node via the variable resistor element.

In one or more embodiments, bandgap reference circuitry comprises a current mirror connected to a power supply line, and supply a third current to an output node, a first pn junction element between the first node and a ground line, a second pn junction element between the second node and the ground line, a first resistor element connected in series to the second pn junction element, and a variable resistor element between the output node and the ground line. The variable resistor element having a resistance dependent on a power supply voltage supplied to the power supply line. The current mirror is configured to supply a first current to a first node, supply a second current to a second node virtually-shorted to the first node.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only some embodiments of this disclosure and are therefore not to be considered limiting of its scope, for the disclosure may admit to other equally effective embodiments.

DETAILED DESCRIPTION

Figure 1:
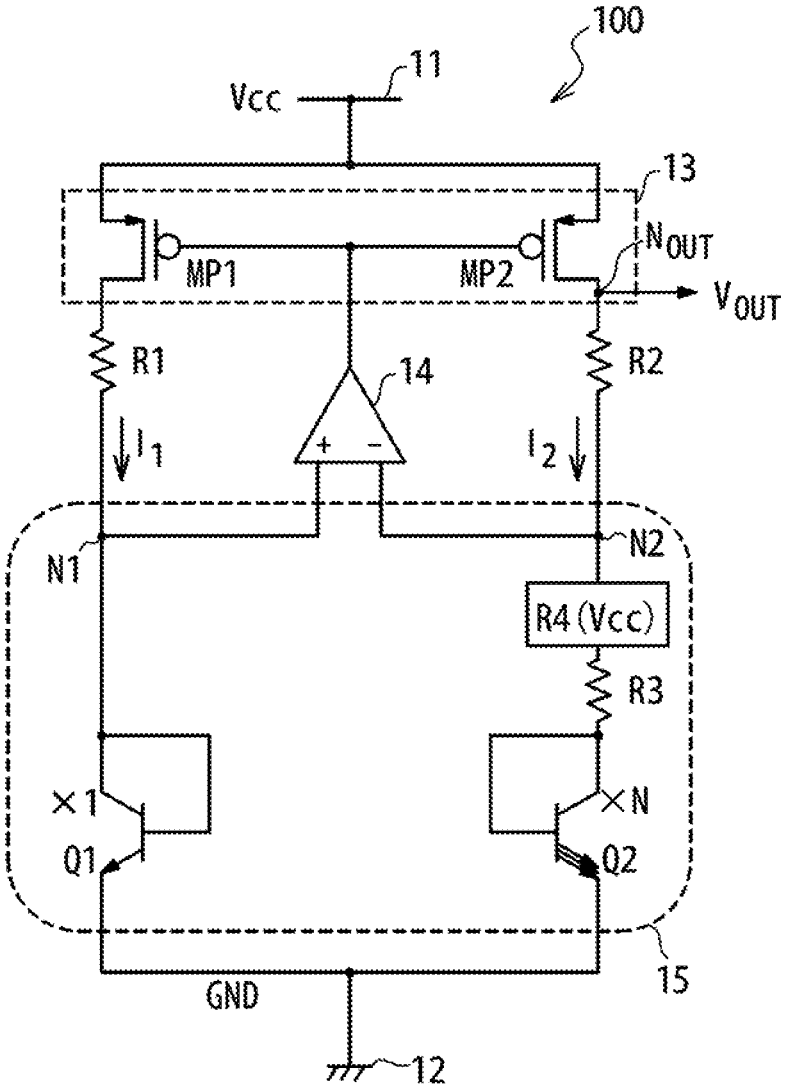
FIG. 1 is a circuit diagram illustrating the configuration of bandgap reference circuitry, according to one or more embodiments.

In the following, a description is given of various embodiments of the present disclosure with reference to the attached drawings. Note that same or similar components may be denoted by same or corresponding reference numerals in the following description.

In one or more embodiments, as illustrated in FIG. 1, bandgap reference circuitry 100 comprises a power supply line 11, a ground line 12, a current mirror 13, an operational amplifier 14, resistor elements R1, R2, R3, a variable resistor element R4, and bipolar transistors Q1 and Q2. In one embodiment, the power supply line 11 is supplied with a power supply voltage Vcc, and the ground line 12 is grounded.

In one or more embodiments, the current mirror is connected to the power supply line 11 and configured to output first and second currents $I_1$ and $I_2$. The first and second currents $I_1$ and $I_2$ may have the same current level. In one or more embodiments, the current mirror 13 comprises a pair of PMOS transistors MP1 and MP2. The PMOS transistors MP1 and MP2 may have commonly connected gates, and the sources thereof may be commonly connected to the power supply line 11. Further, the drain of the PMOS transistor MP1 may be connected to a first node N1 via a resistor element R1, and the drain of the PMOS transistor MP2 may be connected to a second node N2 via a resistor element R2. The drain of the PMOS transistor MP1 may be used as a first output configured to output the first current $I_1$, and the drain of the PMOS transistor MP2 may be used as a second output configured to output the second current $I_2$. In one or more embodiments, the resistor elements R1 and R2 are designed to have the same resistance.

In one or more embodiments, the operational amplifier 14 comprises a first input connected to the first node N1, a second input connected to the second node N2, and an output connected to the gates of the PMOS transistors MP1 and MP2. The first input may be a non-inverting input, and the second input may be an inverting input. In one or more embodiments, the operational amplifier 14 is configured to output a control voltage to the current mirror 13 to control the first and second currents $I_1$ and $I_2$. The operational amplifier 14 may be configured to supply the control voltage to the gates of the PMOS transistors MP1 and MP2. In one or more embodiments, the operational amplifier 14 is configured to control the potential on the gates of the PMOS transistors MP1 and MP2 so that the nodes N1 and N2 have the same potential. In one or more embodiments, the first and second nodes N1 and N2 are virtually-shorted through the above operation of the operational amplifier 14. In one or more embodiments, the current mirror 13 and the operational amplifier 14 operate together as current supply circuitry configured to control the nodes N1 and N2 to the same potential and supply currents of the same current level to the nodes N1 and N2.

In one or more embodiments, the bipolar transistor Q1 is diode-connected to operate as a first pn junction element incorporating a pn junction. In one or more embodiments, an NPN transistor is used as the bipolar transistor Q1. The bipolar transistor Q1 may have an emitter connected to the ground line 12, and a collector and base may be commonly connected to the first node N1. The first current $I_1$ may flow through the pn junction formed between the base and the emitter of the bipolar transistor Q1 in the forward direction.

In one or more embodiments, the bipolar transistor Q2, the resistor element R3, and the variable resistor element R4 are connected in series between the second node N2 and the ground line 12. In FIG. 1, the variable resistor element R4 is denoted by the legend "R4(Vcc)" to indicate that the resistance of the variable resistor element R4 is dependent on the power supply voltage Vcc. In one or more embodiments, the order in which the bipolar transistor Q2, the resistor element R3, and the variable resistor element R4 are connected is interchangeable.

In one or more embodiments, bipolar transistor Q2 is diode-connected to operate as a second pn junction element, similarly to the bipolar transistor Q1. In one or more embodiments, an NPN transistor is used as the bipolar transistor Q2. The area of the base-emitter junction of the bipolar transistor element Q2 may be N times as large as that of the base-emitter junction of the bipolar transistor element Q1, where N is a number larger than 1. In one or more embodiments, the bipolar transistor Q2 has an emitter connected to the ground line 12, and a collector and a base are commonly connected to the second node N2 via the resistor element R3 and the variable resistor element R4. The second current $I_2$ may flow through the pn junction between the base and emitter of the bipolar transistor Q2.

In various embodiments, the diode-connected PNP transistors may be used as the bipolar transistors Q1 and Q2.

In one or more embodiments, parasitic bipolar transistors formed together with MOS transistors may be used as the bipolar transistors Q1 and Q2. This configuration facilitates integration of the bandgap reference circuitry 100 into a MOS transistor-based integrated circuit.

Other elements including a pn junction may be used in place of the diode-connected bipolar transistors Q1 and Q2. For example, in one or more embodiments, diodes including a well formed in a semiconductor substrate and a diffusion layer formed in the well may be used in place of the bipolar transistors Q1 and Q2. Alternatively, diode-connected MOS transistors may be used in place of the diode-connected bipolar transistors Q1 and Q2.

Figure 2:
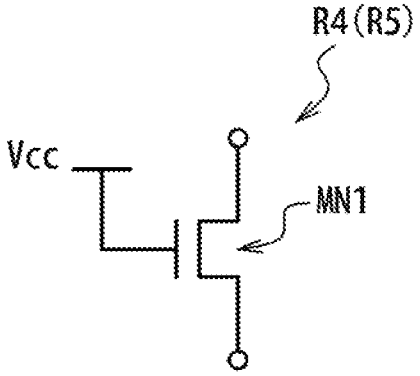
FIG. 2 illustrates an example of the configuration of a variable resistor element, according to one or more embodiments.

In one or more embodiments, the variable resistor element R4 has a resistance dependent on the power supply voltage Vcc supplied to the power supply line 11. In one or more embodiments, as illustrated in FIG. 2, an NMOS transistor MN1 having a gate to which the power supply voltage Vcc is supplied may be used as the variable resistor element R4. The on-resistance of the NMOS transistor MN1, which has the gate configured to receive the power supply voltage Vcc, may depend on the power supply voltage Vcc, and this property allows the NMOS transistor MN1 to be used as the variable resistor element R4. In this case, the resistance of the variable resistor element R4 decreases as the power supply voltage Vcc is increased. A bias voltage generated from the power supply voltage Vcc for example through voltage dividing may be supplied to the gate of the NMOS transistor MN1 used as the variable resistor element R4, in place of the power supply voltage Vcc. In alternative embodiments, a PMOS transistor may be used as the variable resistor element R4.

In one or more embodiments, the output voltage Vout of the bandgap reference circuitry 100 is outputted from an output node Nout configured to connect the drain of the PMOS transistor MP2 and the resistor element R2. In this configuration, the output voltage Vout is generated as the sum of the base-emitter voltage $V_{BE2}$ of the bipolar transistor Q2 and the voltage drops across the resistor elements R2, R3 and the variable resistor element R4. As discussed later in detail, the second current $I_2$, which flows through the resistor elements R2, R3 and the variable resistor element R4, may have a positive temperature dependence against the absolute temperature T, while the base-emitter voltage $V_{BE2}$ of the bipolar transistor Q2 may have a negative temperature dependence against the absolute temperature T. This effectively reduces the temperature dependence of the output voltage Vout of the bandgap reference circuitry 100 against the absolute temperature T. Further, in various embodiments, the bandgap reference circuitry 100 operates to generate the output voltage Vout as described in the following.

In one or more embodiments, the first and second currents $I_1$ and $I_2$, which are supplied to the first and second nodes N1 and N2, respectively, have current levels proportional to the absolute temperature due to the effect of the bipolar transistors Q1, Q2, the resistor element R3 and the variable resistor element R4. In this case, the bipolar transistors Q1, Q2, the resistor element R3, and the variable resistor element R4 may be collectively referred to as PTAT (proportional to absolute temperature) current generator circuitry 15.

More specifically, when the first and second currents $I_1$ and $I_2$ are controlled to have the same current level I by the current mirror 13, for example, the following expressions (1a) and (1b) may hold for the base-emitter voltage $V_{BE1}$ of the bipolar transistor Q1 and the base-emitter voltage $V_{BE2}$ of the bipolar transistor Q2, on the basis that the area of the base-emitter junction of the bipolar transistor Q2 may be N times as large as that of the base-emitter junction of the bipolar transistor Q1:

$$V_{BE1} = \frac{kT}{q}\ln\left(\frac{I}{I_S}\right) \tag{1a}$$

$$V_{BE2} = \frac{kT}{q}\ln\left(\frac{I}{I_S}\cdot\frac{1}{N}\right) \tag{1b}$$

where $I_s$ is the backward saturation current, k is the Boltzmann constant, T is the absolute temperature, and q is the elementary charge.

Since the first and second nodes N1 and N2 may be virtually-shorted and the voltage on the node N2 may be equal to the base-emitter voltage $V_{BE1}$ of the bipolar transistor Q1, the following expression (2) may hold:

$$I = \frac{V_{BE1} - V_{BE2}}{R3 + R4(Vcc)} \tag{2}$$

where R4(Vcc) is the resistance of the variable resistor element R4 and dependent on the power supply voltage Vcc.

The current level I of the currents $I_1$ and $I_2$ may be represented by the following expression (3), which is obtained by substituting expressions (1a) and (1*b*) into expression (2):

$$I = \frac{Vt \cdot \ln(N)}{R3 + R4(Vcc)} \tag{3}$$

where Vt is the thermal voltage given by the following expression (4):

$$Vt = \frac{kT}{q} \tag{4}$$

The current level I of the currents $I_1$ and $I_2$ may be proportional to the absolute temperature T. Since the current $I_2$ increases proportionally to the absolute temperature T, the voltage drops across the resistor elements R2, R3 and the variable resistor elements R4 also increase proportionally to the absolute temperature T.

The output voltage Vout, which is the sum of the voltage drops across the resistor elements R2, R3 and the variable resistor element R4 and the base-emitter voltage $V_{BE2}$ of the bipolar transistor Q2, may be represented, for example, by the following expression (5):

$$\begin{aligned} Vout &= I \cdot (R2 + R3 + R4(Vcc)) + V_{BE2} \\ &= \frac{Vt \cdot \ln(N)}{R3 + R4(Vcc)} \cdot (R2 + R3 + R4(Vcc)) + V_{BE2} \\ &= Vt \cdot \ln(N) \cdot \left(1 + \frac{R2}{R3 + R4(Vcc)}\right) + V_{BE2} \end{aligned} \tag{5}$$

Since the thermal voltage Vt may have a positive temperature dependence and increases proportionally to the temperature while the base-emitter voltage $V_{BE2}$ has a negative temperature dependence, the temperature dependence of the output voltage Vout can be effectively reduced by appropriately adjusting N, R2, R3 and R4.

Additionally, as is understood from expression (5), the dependence of the output voltage Vout on the power supply voltage Vcc can be reduced by selecting the property of the variable resistor element R4 in accordance with the dependence of the output voltage Vout on the power supply voltage Vcc for the case where the variable resistor element R4 is not provided. In one or more embodiments, when the variable resistor element R4 is not provided, the output voltage Vout increases as the power supply voltage Vcc is increased. In such cases, the dependence of the output voltage Vout on the power supply voltage Vcc can be reduced by using a variable resistor element R4 configured to have a resistance that increases as the power supply voltage Vcc is increased. When the output voltage Vout decreases as the power supply voltage Vcc is increased for the case where the variable resistor element R4 is not provided, in contrast, the dependence of the output voltage Vout on the power supply voltage Vcc can be reduced by using a variable resistor element R4 configured to have a resistance that decreases as the power supply voltage Vcc is increased.

Figure 3:
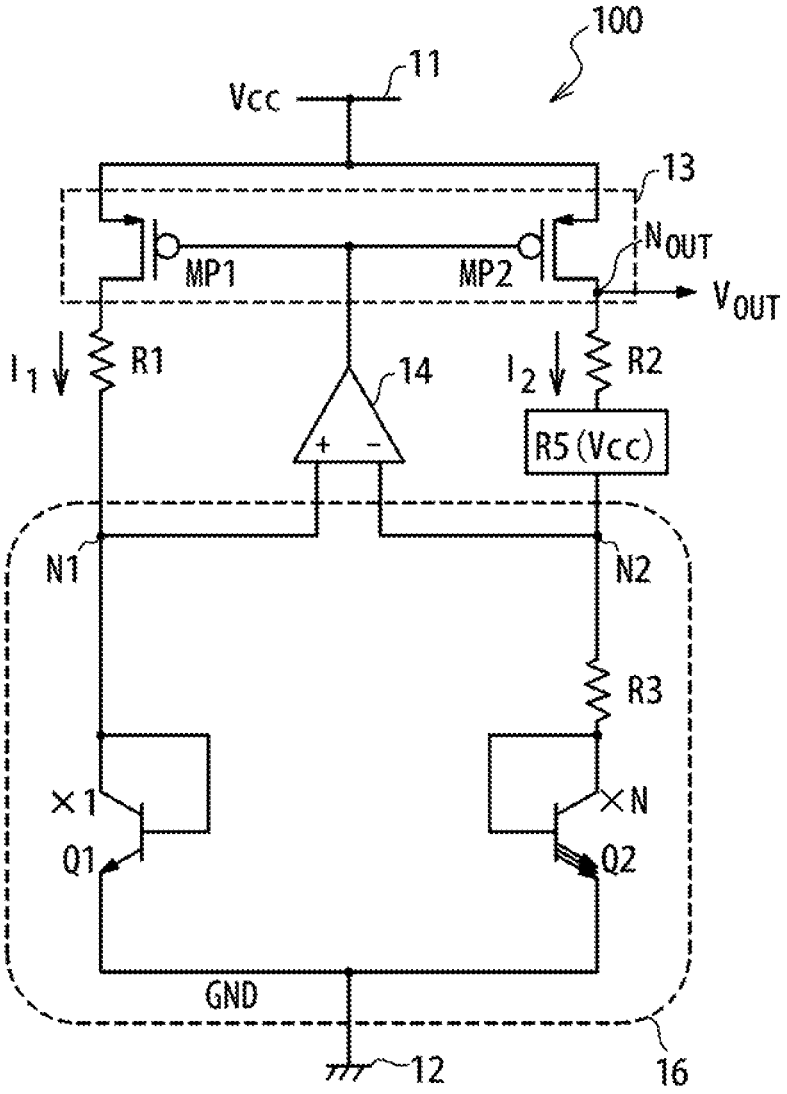
FIGS. 3, 4, 5, 6, 7, 8, 9, 10, 11, 12, 13 and 14 are circuit diagrams illustrating configurations of bandgap reference circuitry, according to one or more embodiments.

In one or more embodiments, as illustrated in FIG. 3, bandgap reference circuitry 100 is configured similarly to the one illustrated in FIG. 1, except that PTAT current generator circuitry 16 does not incorporate the variable resistor element R4 and that the bandgap reference circuitry 100 comprises a variable resistor element R5 connected in series to the resistor element R2 between the output node Nout and the second node N2.

An NMOS transistor having a gate to which the power supply voltage Vcc is supplied may be used as the variable resistor element R5, as is the case with the variable resistor element R4 (also see FIG. 2). In this case, the resistance of the variable resistor element R5 decreases as the power supply voltage Vcc is increased. A bias voltage generated from the power supply voltage Vcc, for example through voltage dividing, may be supplied to the gate of the NMOS transistor used as the variable resistor element R5, in place of the power supply voltage Vcc. In alternative embodiments, a PMOS transistor may be used as the variable resistor element R5. In one or more embodiments, the positions of the resistor elements R2 and the variable resistor element R5 are interchangeable.

In the configuration illustrated in FIG. 3, the voltage on the second node N2 may be equal to the base-emitter voltage $V_{BE1}$ of the bipolar transistor Q1, and accordingly the following expression (6) may hold:

$$I = \frac{V_{BE1} - V_{BE2}}{R3} \tag{6}$$

Therefore, the current level I of the currents $I_1$ and $I_2$ may be obtained by the following expression (7):

$$I = \frac{Vt \cdot \ln(N)}{R3} \tag{7}$$

The output voltage Vout may be the sum of the voltage drops across the resistor element R2, the variable resistor element R5 and the resistor element R3 and the base-emitter voltage $V_{BE2}$ of the bipolar transistor Q2 as is represented for example by the following expression (8):

$$\begin{aligned} Vout &= I \cdot (R2 + R3 + R5(Vcc)) + V_{BE2} \\ &= \frac{Vt \cdot \ln(N)}{R3} \cdot (R2 + R3 + R5(Vcc)) + V_{BE2} \\ &= Vt \cdot \ln(N) \cdot \left(1 + \frac{R2 + R5(Vcc)}{R3}\right) + V_{BE2} \end{aligned} \tag{8}$$

Accordingly, appropriate adjustment of N, R2, R3 and R5(Vcc) makes the output voltage Vout less dependent on the temperature or free from the dependence on the temperature.

In one or more embodiments, the property of the variable resistor element R5 may be selected so that the dependence of the output voltage Vout on the power supply voltage Vcc is reduced in accordance with the dependence of the output voltage Vout on the power supply voltage Vcc for the case where the variable resistor element R5 is not provided. In various embodiments, when the variable resistor element R5 is not provided, the output voltage Vout increases as the power supply voltage Vcc is increased. For example, the dependence of the output voltage Vout on the power supply voltage Vcc can be reduced by using the variable resistor element R5 configured to have a resistance that decreases as the power supply voltage Vcc is increased. When the output voltage Vout decreases as the power supply voltage Vcc is increased for the case where the variable resistor element R5 is not provided, in contrast, the dependence of the output voltage Vout on the power supply voltage Vcc can be reduced by using a variable resistor element R5 configured to have a resistance that increases as the power supply voltage Vcc is increased.

Figure 4:
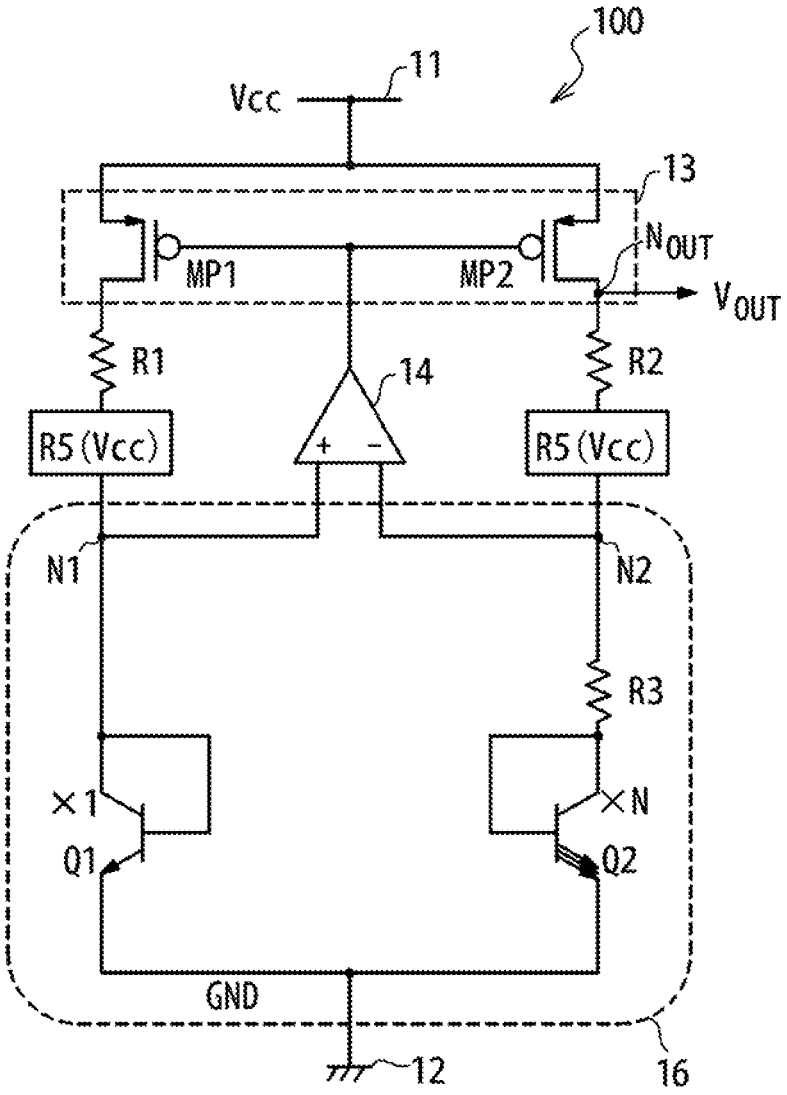

In one or more embodiments, as illustrated in FIG. 4, bandgap reference circuitry 100 is configured similarly to the one illustrated in FIG. 3, except that the bandgap reference circuitry 100 comprises another variable resistor element R5 connected in series to the resistor element R1 between the first node N1 and the drain of the PMOS transistor MP1, in addition to the variable resistor element R5 connected in series to the resistor element R2 between the second node N2 and the drain of MP2. This circuit configuration is more symmetric and effectively reduces the difference between the current levels of the first and second currents $I_1$ and $I_2$ potentially caused by the Early effect of the PMOS transistors MP1 and MP2. In one or more embodiments, the positions of the resistor element R1 and the variable resistor element R5 are interchangeable.

Figure 5:
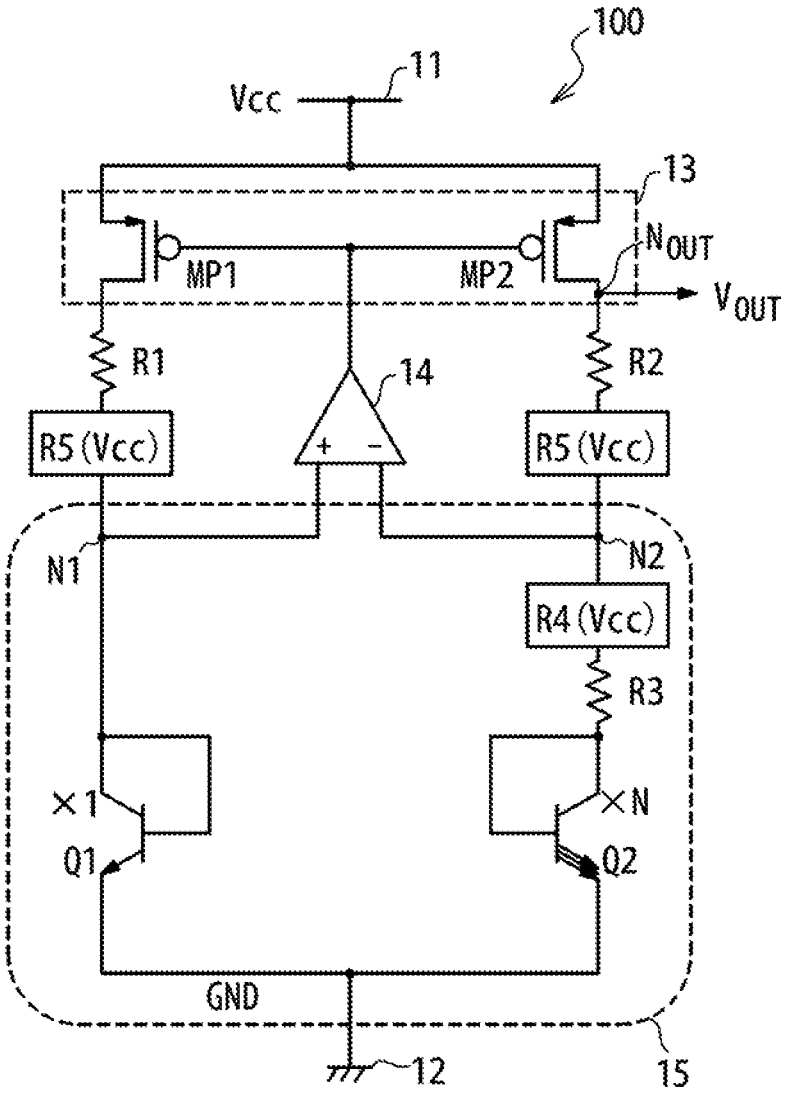

In one or more embodiments, as illustrated in FIG. 5, bandgap reference circuitry 100 is configured as a combination of the configuration illustrated in FIG. 1 and that illustrated in FIG. 4. The bandgap reference circuitry 100 illustrated in FIG. 5 comprises the PTAT current generator circuitry 15 that incorporates the variable resistor element R4. Additionally, the resistor element R1 and the variable resistor element R5 are connected in series between the first node N1 and the drain of the PMOS transistor MP1, and the resistor element R2 and another variable resistor element R5 are connected in series between the second node N2 and the drain of the PMOS transistor MP2.

In the configuration illustrated in FIG. 5, the output voltage Vout, which is the sum of the voltage drops across the resistor element R2, the variable resistor element R5, the variable resistor element R4 and the resistor element R3 and the base-emitter voltage $V_{BE2}$ of the bipolar transistor Q2, may be represented, for example, by the following expression (9):

$$\begin{aligned} Vout &= I\cdot(R2+R3+R4(Vcc)+R5(Vcc))+V_{BE2} \\ &= \frac{V_T\cdot\ln(N)}{R3+R4(Vcc)}\cdot(R2+R3+R4(Vcc)+R5(Vcc))+V_{BE2} \\ &= V_T\cdot\ln(N)\cdot\left(1+\frac{R2+R5(Vcc)}{R3+R4(Vcc)}\right)+V_{BE2} \end{aligned} \tag{9}$$

Expression (9) may be obtained on the basis of the fact that the current level I of the currents $I_1$ and $I_2$ is given by the above-described expression (3).

In one or more embodiments, N, R2, R3, R4(Vcc) and R5(Vcc) are adjusted so as to make the generated output voltage Vout less dependent on the temperature or free from the temperature dependence, on the basis of expression (9).

The properties of the variable resistor elements R4 and R5 may be selected so as to reduce the dependence of the output voltage Vout on the power supply voltage Vcc, in accordance with the dependence of the output voltage Vout on the power supply voltage Vcc in the embodiment where the variable resistor elements R4 and R5 are not provided.

Figure 6:
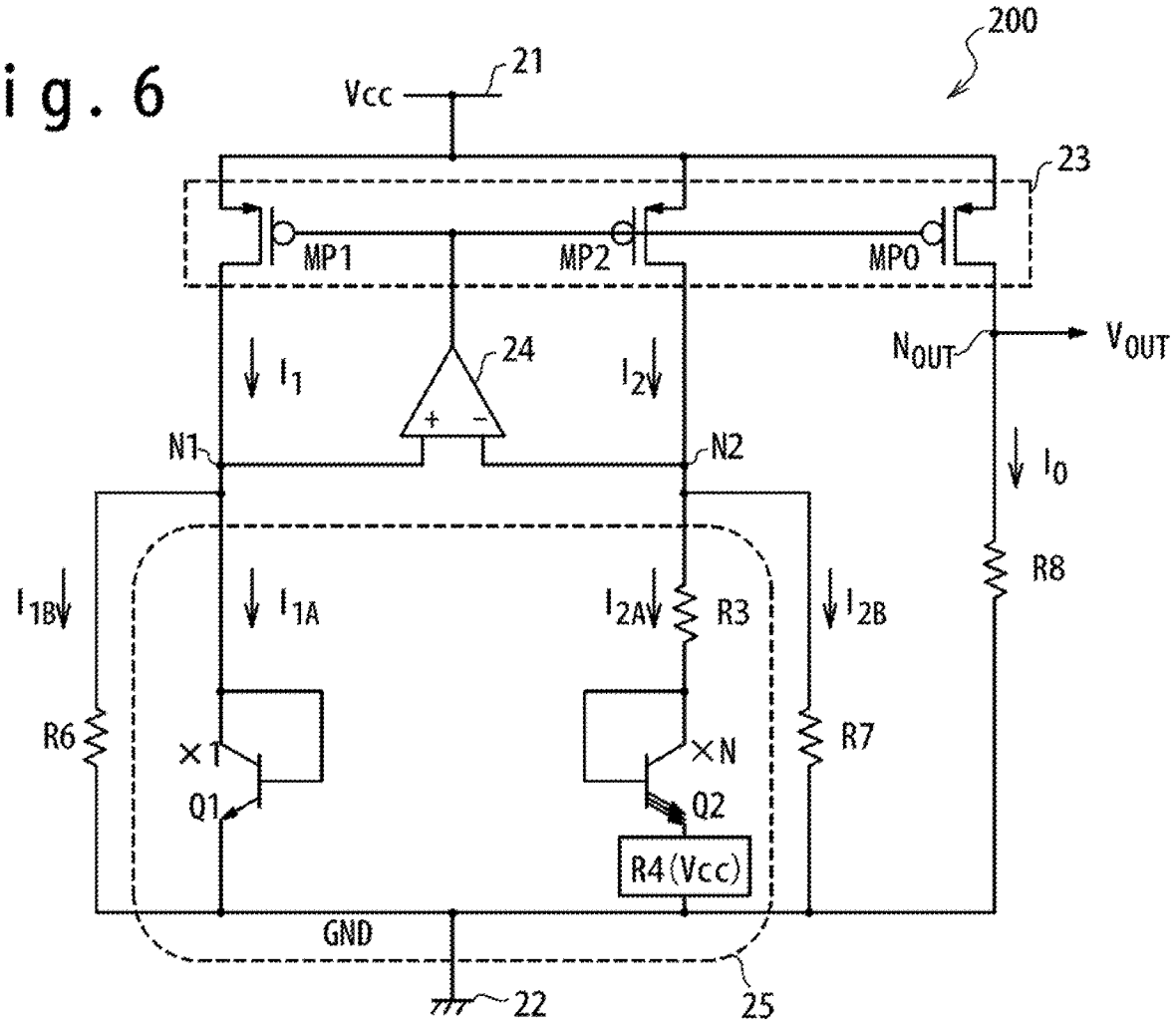

In one or more embodiments, as illustrated in FIG. 6, bandgap reference circuitry 200 comprises a power supply line 21, a ground line 22, a current mirror 23, an operational amplifier 24, resistor elements R3, R6, R7 and R8, a variable resistor element R4 and bipolar transistors Q1 and Q2. Further, in one embodiment, the power supply line 21 is supplied with the power supply voltage Vcc, and the ground line 22 is grounded.

In one embodiment, the current mirror 23 is configured to output first and second currents $I_1$ and $I_2$. The first and second currents $I_1$ and $I_2$ may have the same current level. Additionally, the current mirror 23 may be configured to output a third current $I_0$ having a current level proportional to that of the first and second currents $I_1$ and $I_2$. In one or more embodiments, the current mirror 23 may be configured to output the third current $I_0$ so that the third current $I_0$ has the same current level as that of the first and second currents $I_1$ and $I_2$. In one or more embodiments, the current mirror 23 may comprise PMOS transistors MP0, MP1 and MP2. The PMOS transistors MP0, MP1 and MP2 may have commonly-connected gates, and the sources thereof may be commonly connected to the power supply line 21. The drain of the PMOS transistor MP1 may be connected to a first node N1, and the drain of the PMOS transistor MP2 may be connected to a second node N2. The drain of the PMOS transistor MP0 is connected to an output node Nout.

In various embodiments, the operational amplifier 24 has a first input connected to the first node N1, a second input connected to the second node N2, and an output connected to the gates of the PMOS transistors MP1 and MP2. The first input may be a non-inverting input, and the second input may be an inverting input. In one or more embodiments, the operational amplifier 24 is configured to output a control voltage to the gates of the PMOS transistors MP1, MP2 and MP0 of the current mirror 23 to control the first, second and third currents $I_1$, $I_2$ and $I_0$. Further, the operational amplifier 24 may control the potential of the gates of the PMOS transistors MP1 and MP2 so that the first and second nodes N1 and N2 have the same potential. In one or more embodiments, the nodes N1 and N2 are virtually-shorted through the above operation of the operational amplifier 24. In one or more embodiments, the current mirror 23 and the operational amplifier 24 operate together as current supply circuitry configured to control the nodes N1 and N2 to the same potential and supply currents of the same current level to the nodes N1 and N2.

In one or more embodiments, the bipolar transistors Q1, Q2, the resistor element R3 and the variable resistor element R4 operates as PTAT current generator circuitry 25, similarly to the case of the bandgap reference circuitry 100 illustrated in FIG. 1. The bipolar transistor Q1 is connected between the node N1 and the ground line 22. The resistor element R3, the bipolar transistor Q2 and the variable resistor element R4 are connected in series between the node N1 and the ground line 22. The area of the base-emitter junction of the bipolar transistor Q2 may be N times as large as that of the base-emitter junction of the bipolar transistor Q1. In one or more embodiments, the order in which the resistor element R3, the bipolar transistor Q2 and the variable resistor element R4 are connected is interchangeable.

As is illustrated, in one embodiment, the resistor element R6 is connected in parallel to the bipolar transistor Q1 between the node N1 and the ground line 22, and the resistor element R7 is connected in parallel to the resistor element R3. Further, the bipolar transistor Q2 and the variable resistor element R4 are connected between the node N2 and the ground line 22. In one or more embodiments, the resistor elements R6 and R7 are designed to have the same resistance.

In one or more embodiments, the resistor element R8 is connected between the output node Nout and the ground line 22. The resistor element R8 may configured to generate an output voltage Vout from the current $I_0$ supplied to the output node Nout.

The bandgap reference circuitry 200 may be configured to generate the output voltage Vout so that the temperature dependence of the output voltage Vout is reduced. The current $I_{1A}$ flowing through the bipolar transistor Q1 and the current $I_{2A}$ flowing through the resistor element R3, the bipolar transistor Q2 and the variable resistor element R4 may both be a PTAT current having a positive temperature dependence. Further, the current $I_{1B}$ flowing through the resistor element R6 and the current $I_{2B}$ flowing through the resistor element R7 may both be a CTAT (complementary to absolute temperature) current having a negative temperature dependence. Since the current $I_1$ is the sum current of the currents $I_{1A}$ and $I_{1B}$ and the current $I_2$ is the sum current of the currents $I_{2A}$ and $I_{2B}$, the temperature dependences of the currents $I_1$ and $I_2$ is reduced.

Accordingly, in one or more embodiments, the temperature dependence of the current $I_0$, which is generated through mirroring of the currents $I_1$ and $I_2$, is also reduced. Further, as the output voltage Vout may be generated through a voltage drop across the resistor element R8 caused by the current $I_0$, the temperature dependence of the output voltage Vout is also reduced.

In one or more embodiments, the current $I_2$ supplied to the node N2 is the sum current of the currents $I_{2A}$ and $I_{2B}$ and the following expression (10) holds:

$$I_2=I_{2A}+I_{2B} \tag{10}$$

Since the nodes N1 and N2 are virtually-shorted, the potential on the node N2 may be equal to the base-emitter voltage $V_{BE1}$ of the bipolar transistor Q1, and accordingly the currents $I_{2A}$ and $I_{2B}$ may be represented by the following expressions (11a) and (11b):

$$I_{2A} = \frac{V_{BE1} - V_{BE2}}{R3 + R4(Vcc)} \tag{11a}$$

$$I_{2B} = \frac{V_{BE1}}{R7} \tag{11b}$$

From expressions (1a) and (1b), which represent the base-emitter voltages $V_{BE1}$ and $V_{BE2}$, and expressions (10), (11a) and (11b), the current $I_2$ may be represented by the following expression (12):

$$I_2 = \frac{Vt \cdot \ln(N)}{R3 + R4(Vcc)} + \frac{V_{BE1}}{R7} \tag{12}$$

When the current mirror 23 is configured to output the current $I_0$ so that the current $I_0$ has the same current level as that of the current $I_2$, the output voltage Vout may be represented, for example, by the following expression (13):

$$Vout = \left(\frac{Vt \cdot \ln(N)}{R3 + R4(Vcc)} + \frac{V_{BE1}}{R7}\right) \cdot R8 \tag{13}$$

Since the thermal temperature Vt has a positive temperature dependence and increases proportionally to the temperature while the base-emitter voltage $V_{BE1}$ has a negative temperature dependence, the temperature dependence of the output voltage Vout may be effectively reduced by appropriately adjusting N, R2, R3, R4(Vcc) and R7, as is understood from expression (13).

Additionally, in one or more embodiments, the dependence of the output voltage Vout on the power supply voltage Vcc may also be reduced by selecting the property of the variable resistor element R4, in accordance with the dependence of the output voltage Vout on the power supply voltage Vcc in an embodiment where the variable resistor element R4 is not provided.

Figure 7:
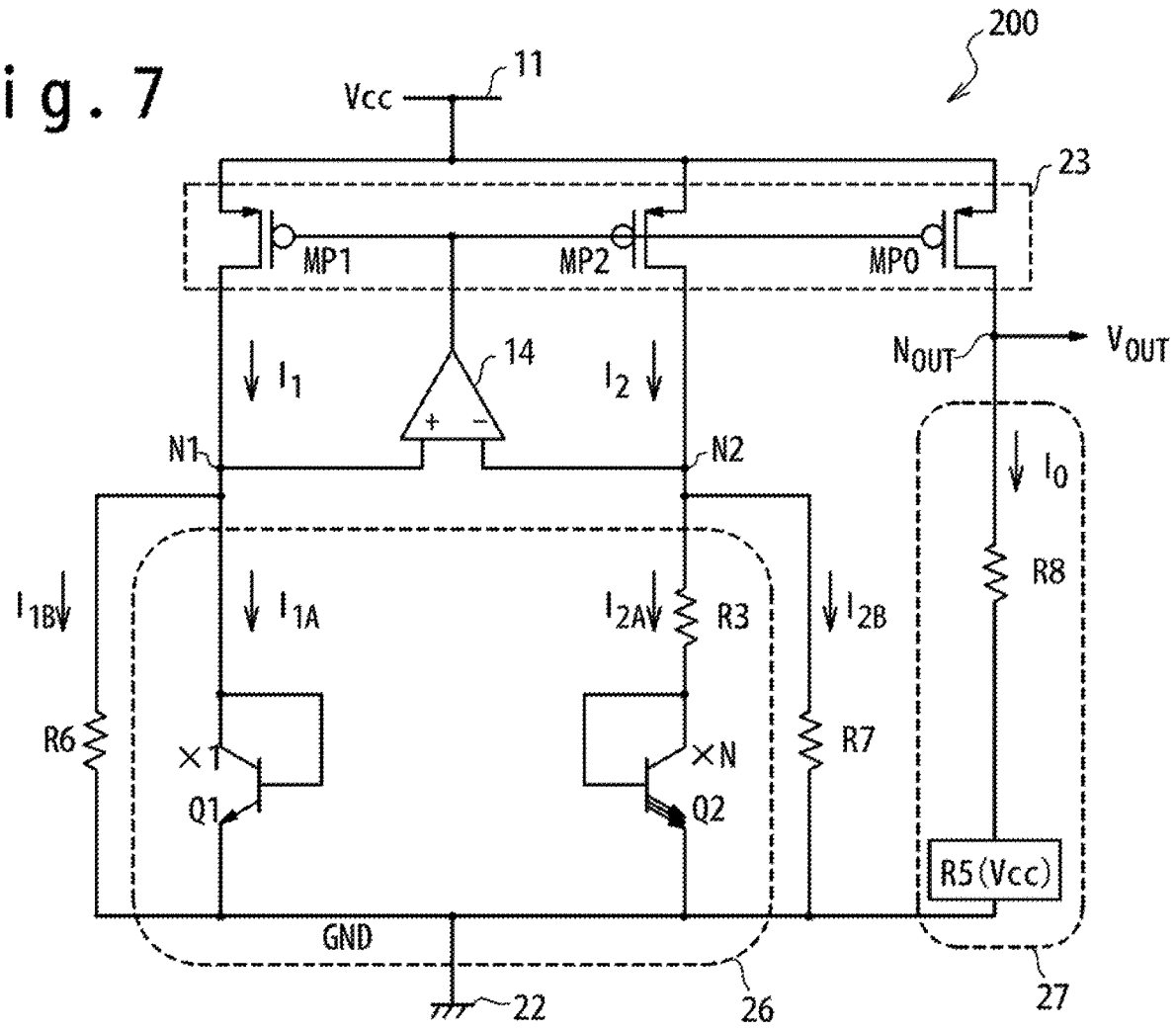

In one or more embodiments, as illustrated in FIG. 7, bandgap reference circuitry 200 is configured similarly to the one illustrated in FIG. 6, except that PTAT current generator circuitry 26 does not incorporate the variable resistor element R4, while current-voltage converter circuitry 27 is connected between the output node Nout and the ground line 22. The current-voltage converter circuitry 27 comprises the resistor element R8 and the variable resistor element R5 which are serially connected.

In the bandgap reference circuitry 200 illustrated in FIG. 7, the current $I_2$ may be represented, for example, by the following expression (14):

$$I_2 = \frac{Vt \cdot \ln(N)}{R3} + \frac{V_{BE1}}{R7} \tag{14}$$

Accordingly, the output voltage Vout may be represented, for example, by the following expression (15):

$$Vout = \left(\frac{Vt \cdot \ln(N)}{R3} + \frac{V_{BE1}}{R7}\right) \cdot (R8 + R5(Vcc)) \tag{15}$$

As may be understood from expression (15), the temperature dependence of the output voltage Vout may be reduced by appropriately adjusting N, R2, R3 and R7.

Additionally, in one or more embodiments, the dependence of the output voltage Vout on the power supply voltage Vcc may be also reduced by appropriately selecting the property of the variable resistor element R5 in accordance with the dependence of the output voltage Vout on the power supply voltage Vcc in an embodiment where the variable resistor element R5 is not provided.

Figure 8:
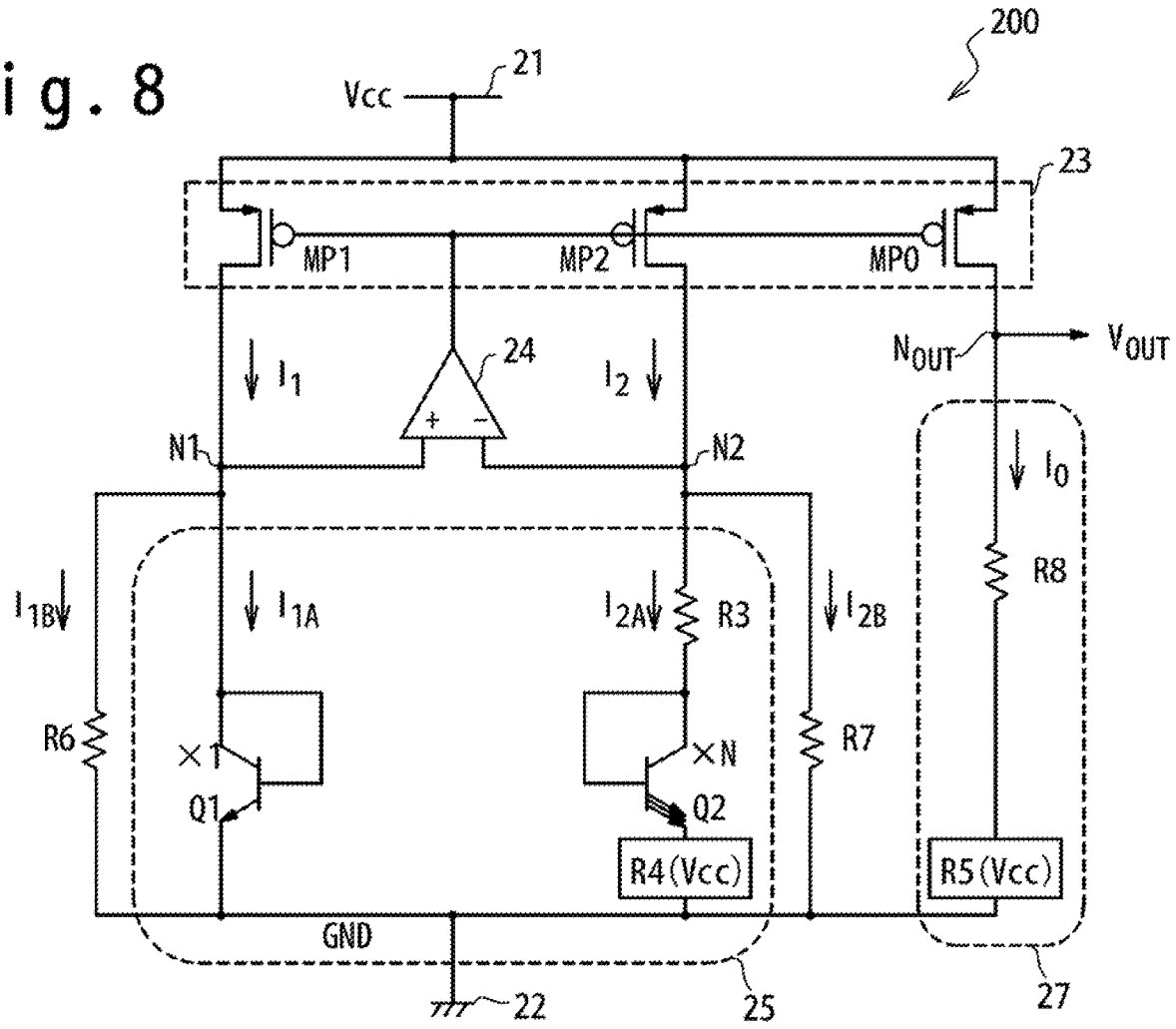

In one or more embodiments, as illustrated in FIG. 8, bandgap reference circuitry 200 is configured as a combination of the configuration illustrated in FIG. 6 and that illustrated in FIG. 7. In the configuration illustrated in FIG. 8, PTAT current generator circuitry 25 incorporates the variable resistor element R4. Additionally, current-voltage converter circuitry 27 is connected between the output node Nout and the ground line 22. The current-voltage converter circuitry 27 includes the resistor element R8 and the variable resistor element R5 which are connected in series.

In the configuration illustrated in FIG. 8, the output voltage Vout may be represented, for example, by the following expression (16):

$$Vout = \left(\frac{Vt \cdot \ln(N)}{R3 + R4(Vcc)} + \frac{V_{BE1}}{R7}\right) \cdot (R8 + R5(Vcc)) \tag{16}$$

In one or more embodiments, N, R3, R4(Vcc) and R7 are adjusted so as to make the generated output voltage Vout less dependent on the temperature or free from the temperature dependence, on the basis of expression (16).

The properties of the variable resistor elements R4 and R5 are adjusted so as to reduce the dependence of the output voltage Vout on the power supply voltage Vcc, in accordance with the dependence of the output voltage Vout on the power supply voltage Vcc when the variable resistor elements R4 and R5 are not provided.

Figure 9:
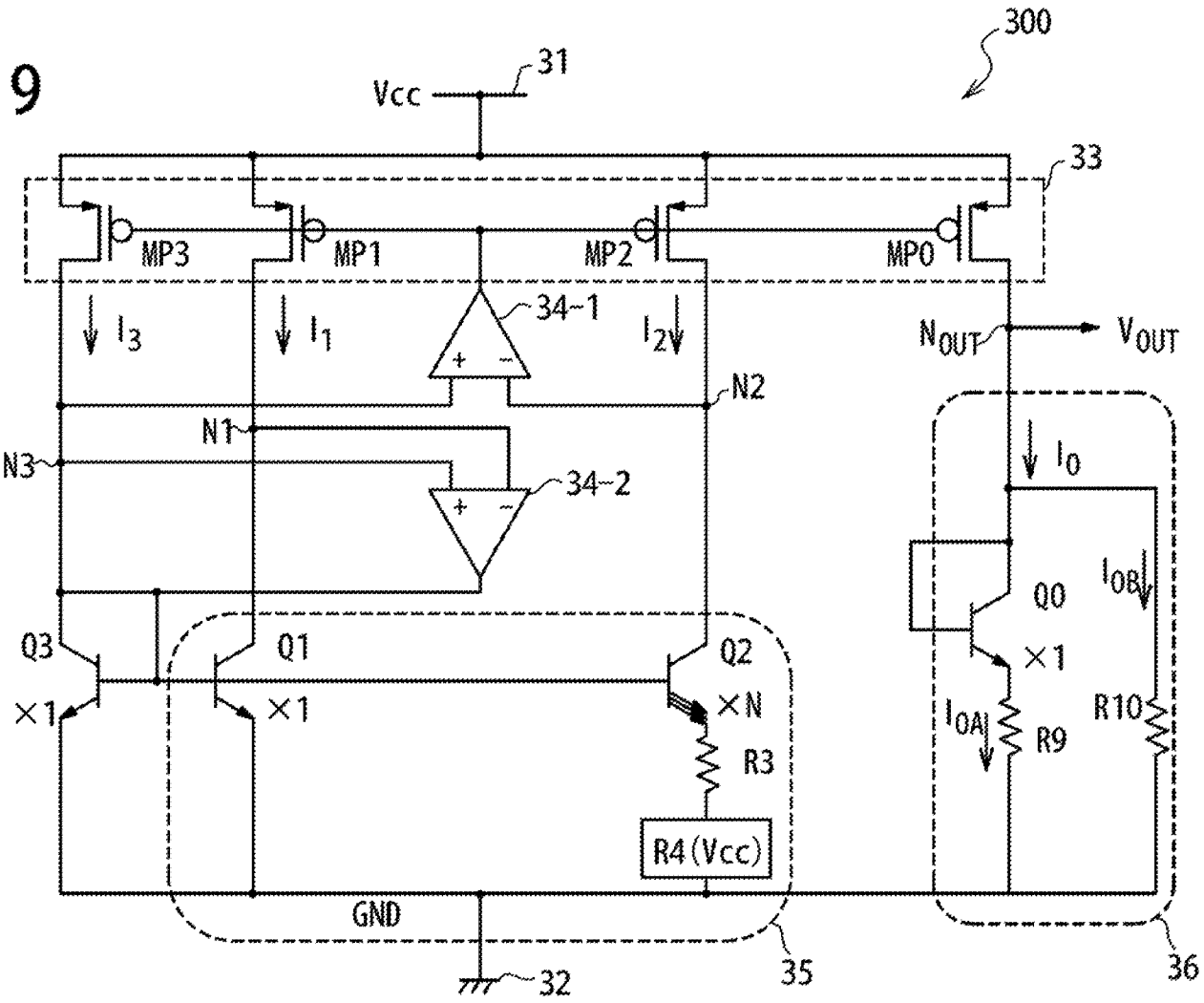

In one or more embodiments, as illustrated in FIG. 9, bandgap reference circuitry 300 comprises a power supply line 31, a ground line 32, a current mirror 33, first and second operational amplifiers 34-1 and 34-2, a resistor element R3, a variable resistor element R4, bipolar transistors Q1, Q2, Q3 and one embodiment, the power supply line 31 is supplied with the power supply voltage Vcc, and the ground line 32 is grounded.

In one or more embodiments, the current mirror is configured to output first and second currents $I_1$ and $I_2$, third current $I_0$, and fourth current $I_3$. The currents $I_0$, $I_1$, $I_2$ and $I_3$ may have the same current level. In various embodiments, the current mirror 33 comprises PMOS transistors MP0, MP1, MP2 and MP3. The PMOS transistors MP0, MP1, MP2 and MP3 may have commonly-connected gates, and the sources thereof may be commonly connected to the power supply line 31. Further the drains of the PMOS transistors MP1, MP2 and MP3 may be connected to the first, second and third nodes N1, N2 and N3, respectively, and the drain of the PMOS transistor MP0 may be connected to the output node Nout.

In one or more embodiments, the bipolar transistors Q1, Q2 and Q3 operate as first, second and third pn junction elements, respectively, each incorporating a pn junction. In one or more embodiments, NPN transistors are used as the bipolar transistors Q1, Q2 and Q3. The bases of the bipolar transistors Q1, Q2 and Q3 may be commonly connected to the collector of the bipolar transistor Q3. The collectors of the bipolar transistors Q1, Q2 and Q3 may be connected to the first, second and third nodes N1, N2 and N3, respectively. In one or more embodiments, the emitters of the bipolar transistors Q1 and Q3 are connected to the ground line 32, and the emitter of the bipolar transistor Q2 is connected to the ground line 32 via the resistor element R3 and the variable resistor element R4. The above connections allow the first, second, and fourth currents $I_1$, $I_2$ and $I_3$ to flow through the base-emitter pn junctions of the bipolar transistors Q1, Q2 and Q3, respectively, in the forward directions.

In one or more embodiments, the base-emitter junctions of the bipolar transistors Q1 and Q3 have the same area. Further, the area of the base-emitter junction of the bipolar transistor Q2 may be N times as large as that of the base-emitter junctions of the bipolar transistors Q1 and Q3, where N is a number larger than 1.

In various embodiments, the first operational amplifier 34-1 has a first input connected to the first node N1, a second input connected to the second node N2, and an output connected to the gates of the PMOS transistors MP0, MP1, MP2 and MP3. The first input may be an inverting input, and the second input may be a non-inverting input. The first operational amplifier 34-1 may output a control voltage to the gates of the PMOS transistors MP1 and MP2 of the current mirror 33 to control the first and second currents $I_1$ and $I_2$.

In one or more embodiments, the second operational amplifier 34-2 has a first input connected to the first node N1, a second input connected to the third node N3, and an output connected to the bases of the bipolar transistors Q1, Q2 and Q3. The first input may be a non-inverting input, and the second input may be an inverting input. The second operational amplifier 34-2 may output a control voltage to the bases of the bipolar transistors Q1, Q2 and Q3 to control the first and third currents $I_1$ and $I_3$.

In various embodiments, the first and second operational amplifiers 34-1 and 34-2 are configured to control the potential on the gates of the PMOS transistors MP1, MP2 and MP3 and the potential on the bases of the bipolar transistors Q1, Q2 and Q3 so that the first, second and third nodes N1, N2 and N3 have the same potential. In one or more embodiments, the first, second and third nodes N1, N2 and N3 are virtually-shorted through the above operation of the first and second operational amplifiers 34-1 and 34-2. In one or more embodiments, the current mirror 33 and the operational amplifiers 34-1 and 34-2 collectively operate as current supply circuitry configured to control the nodes N1, N2 and N3 to the same potential and supply currents of the same current level to the nodes N1, N2 and N3.

The current-voltage converter circuitry 36 may generate the output voltage Vout from the third current $I_0$ received from the current mirror 33. In one or more embodiments, the current-voltage converter circuitry 36 comprises a diode-connected bipolar transistor Q0 and resistor elements R9 and R10. Further, the base-emitter junction of the bipolar transistor Q0 may have the same area as that of the base-emitter junctions of the bipolar transistors Q1 and Q3. The bipolar transistor Q0 and the resistor element R9 may be connected in series between the output node Nout and the ground line 32. In various embodiments, the positions of the bipolar transistor Q0 and the resistor element R9 are interchangeable. In one embodiment, the resistor element R10 is connected between the output node Nout and the ground line 32 in parallel to the bipolar transistor Q0 and the resistor element R9.

Figure 10:
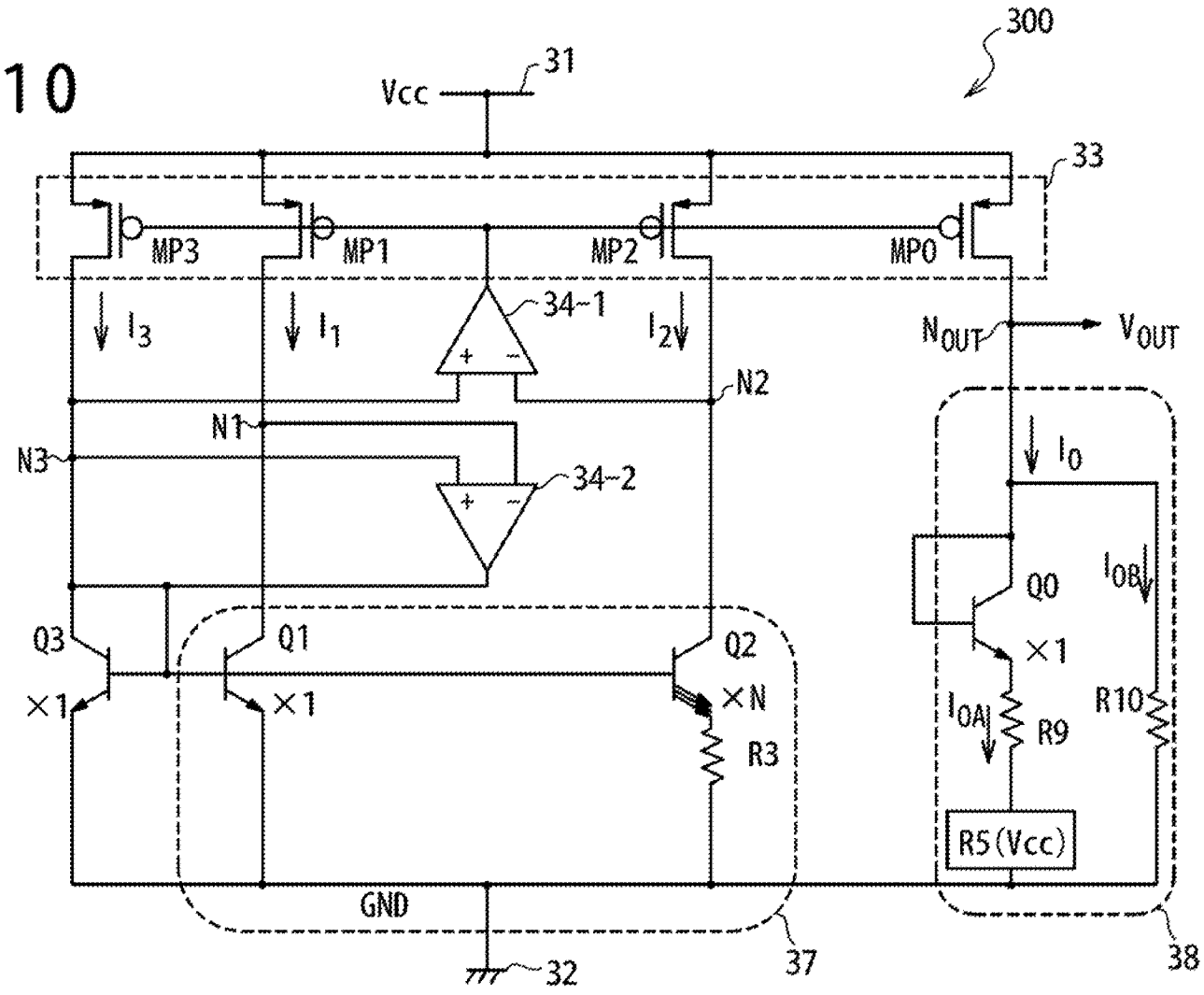

In one or more embodiments, the bandgap reference circuitry 300 illustrated in FIG. 10 is configured to generate an output voltage Vout with reduced temperature dependence in accordance with the principle described in the following. The first current $I_1$, which flows through the bipolar transistor Q1, and the second current $I_2$, which flows through the bipolar transistor Q2, the resistor element R3 and the variable resistor element R4, are both PTAT currents having positive temperature dependence. In such an embodiment, the bipolar transistors Q1, Q2, the resistor element R3 and the variable resistor element R4 may be collectively referred to as PTAT current generator circuitry 35.

The third current $I_0$ supplied to the current-voltage converter circuitry 36 may also be a PTAT current, since the current $I_0$ has the same current level I as the currents $I_1$ and $I_2$. The current-voltage converter circuitry 36 may be configured to divide the third current $I_0$ into a current $I_{0A}$ having a positive temperature dependence and a current $I_{0B}$ having a reduced temperature dependence, and output a voltage generated across the resistor element R10 by the current $I_{0B}$ as the output voltage Vout. Accordingly, the bandgap reference circuitry 300 may reduce the temperature dependence of the output voltage Vout. In various embodiments, the bandgap reference circuitry 300 generates the output voltage Vout as described in the following.

In the configuration illustrated in FIG. 9, and in one or more embodiments, the first, second and third currents $I_1$, $I_2$ and $I_0$ have the same current level I, which may be represented by the following expression (17):

$$I = \frac{Vt \cdot \ln(N)}{R3 + R4(Vcc)} \tag{17}$$

Since the third current $I_0$ has the same current level I as the first and second currents $I_1$ and $I_2$ and is generated as the sum current of the current $I_{0A}$ flowing through the bipolar transistor Q0 and the resistor element R9 and the current $I_{0B}$ flowing through the resistor element R10, the following expression (18) holds:

$$I_0 = I = I_{0A} + I_{0B} \tag{18}$$

With respect to the base-emitter voltage $V_{BE0}$ of the bipolar transistor Q0 and the voltage drops across the resistor elements R9 and R10, the following expression (19) holds:

$$V_{BE0} + I_{0A} \cdot R9 = I_{0B} \cdot R10 \tag{19}$$

From expressions (17) to (19), the current $I_{0B}$ may be represented by the following expression (20):

$$\begin{aligned} I_{0B} &= \frac{I \cdot R9 + V_{BE0}}{R9 + R10} \\ &= \frac{1}{R9 + R10} \cdot \left( \frac{R9 \cdot Vt \cdot \ln(N)}{R3 + R4(Vcc)} + V_{BE0} \right) \end{aligned} \tag{20}$$

The output voltage Vout may be represented, for example, by the following expression (21):

$$\begin{aligned} Vout &= I_{0B} \cdot R10 \\ &= \frac{R10}{R9 + R10} \cdot \left( \frac{R9 \cdot Vt \cdot \ln(N)}{R3 + R4(Vcc)} + V_{BE0} \right) \end{aligned} \tag{21}$$

Since the thermal voltage Vt has a positive temperature dependence and increases proportionally to the temperature while the base-emitter voltage $V_{BE0}$ has a negative temperature dependence, the temperature dependence of the output voltage Vout can be effectively reduced by appropriately adjusting N, R3, R4(Vcc) and R9.

Additionally, as is understood from expression (21), the dependence of the output voltage Vout on the power supply voltage Vcc can be also reduced by appropriately selecting the property of the variable resistor element R4 in accordance with the dependence of the output voltage Vout on the power supply voltage Vcc in an embodiment where the variable resistor element R4 is not provided.

In one or more embodiments, as illustrated in FIG. 10, bandgap reference circuitry 300 is configured similarly to the one illustrated in FIG. 9, except that PTAT current generator circuitry 37 does not incorporate the variable resistor element R4 and that current-voltage converter circuitry 38 is used in which a variable resistor element R5 is connected in series to the bipolar transistor Q0 and the resistor element R9. In one or more embodiments, the order in which the bipolar transistor Q0, the resistor element R9 and the variable resistor element R5 are connected is interchangeable.

In one or more embodiments, the first, second and third currents $I_1$, $I_2$ and $I_0$ have the same current level I, which may be represented by the following expression (22):

$$I = \frac{Vt \cdot \ln(N)}{R3} \tag{22}$$

With respect to the base-emitter voltage $V_{BE0}$ and the voltage drops across the resistor elements R9 and R10, the following expression (23) holds:

$$V_{BE0} + I_{0A} \cdot (R9 + R5(Vcc)) = I_{0B} \cdot R10 \tag{23}$$

From expressions (18), (22) and (23), the current $I_{0B}$ may be represented by the following expression (24):

$$\begin{aligned} I_{0B} &= \frac{I \cdot (R9 + R5(Vcc)) \cdot V_{BE0}}{R9 + R5(Vcc) + R10} \\ &= \frac{1}{R9 + R10 + R5(Vcc)} \cdot \left( \frac{(R9 + R5(Vcc)) \cdot Vt \cdot \ln(N)}{R3} + V_{BE0} \right) \end{aligned} \tag{24}$$

The output voltage Vout may be represented, for example, by the following expression (25):

$$\begin{aligned} Vout &= I_{0B} \cdot R10 \\ &= \frac{R10}{R9 + R10 + R5(Vcc)} \cdot \left( \frac{(R9 + R5(Vcc)) \cdot Vt \cdot \ln(N)}{R3} + V_{BE0} \right) \end{aligned} \tag{25}$$

Since the thermal voltage Vt has a positive temperature dependence and increases proportionally to the temperature while the base-emitter voltage $V_{BE1}$ has a negative temperature dependence, as is understood from expression (25), the temperature dependence of the output voltage can be reduced by appropriately adjusting N, R3, R9 and R5(Vcc).

Additionally, the dependence of the output voltage Vout on the power supply voltage Vcc can be effectively reduced by appropriately selecting the property of the variable resistor element R5 in accordance with the dependence of the output voltage Vout on the power supply voltage Vcc in an embodiment where the variable resistor element R5 is not provided.

Figure 11:
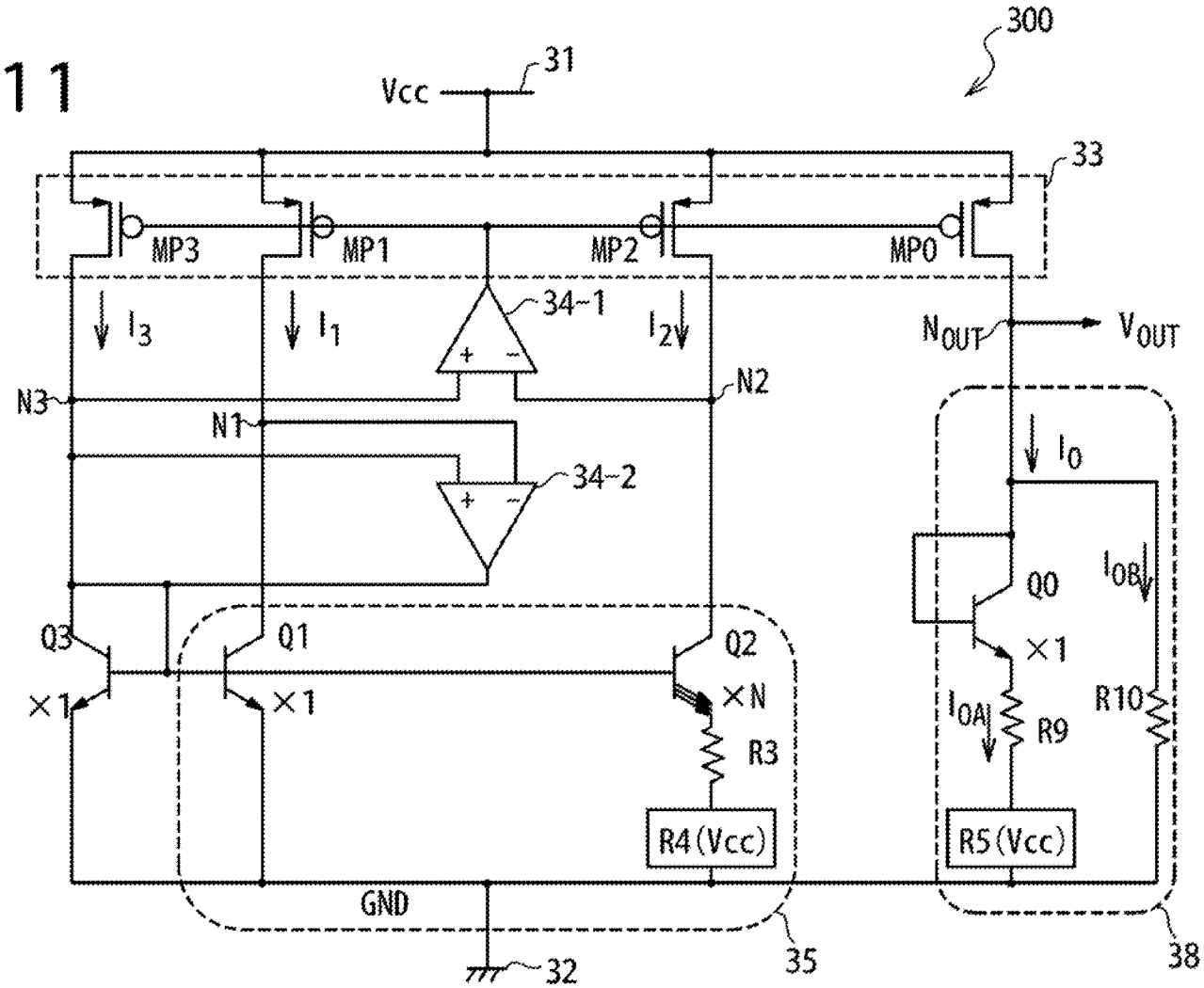

In one or more embodiments, as illustrated in FIG. 11, bandgap reference circuitry 300 is configured as a combination of the configuration illustrated in FIG. 9 and that illustrated in FIG. 10. In the configuration illustrated in FIG. 11, PTAT current generator circuitry 35 incorporates a variable resistor element R4. Additionally, current-voltage converter circuitry 38 is used, in which the resistor element R5 is connected in series to the bipolar transistor Q0 and the resistor element R9.

In the configuration illustrated in FIG. 11, the output voltage Vout may be represented, for example, by the following expression (26):

$$Vout = \frac{R10}{R9 + R10 + R5(Vcc)} \cdot \left( \frac{(R9 + R5(Vcc)) \cdot Vt \cdot \ln(N)}{R3 + R4(Vcc)} + V_{BE0} \right) \tag{26}$$

In one or more embodiments, N, R3, R4(Vcc), R5(Vcc) and R9 are adjusted so as to make the generated output voltage Vout less dependent on the temperature or free from the temperature dependence, on the basis of expression (26).

The properties of the variable resistor elements R4 and R5 are adjusted so as to reduce the dependence of the output voltage Vout on the power supply voltage Vcc, in accordance with the dependence of the output voltage Vout on the power supply voltage Vcc for an embodiment where the variable resistor elements R4 and R5 are not provided.

Figure 12:
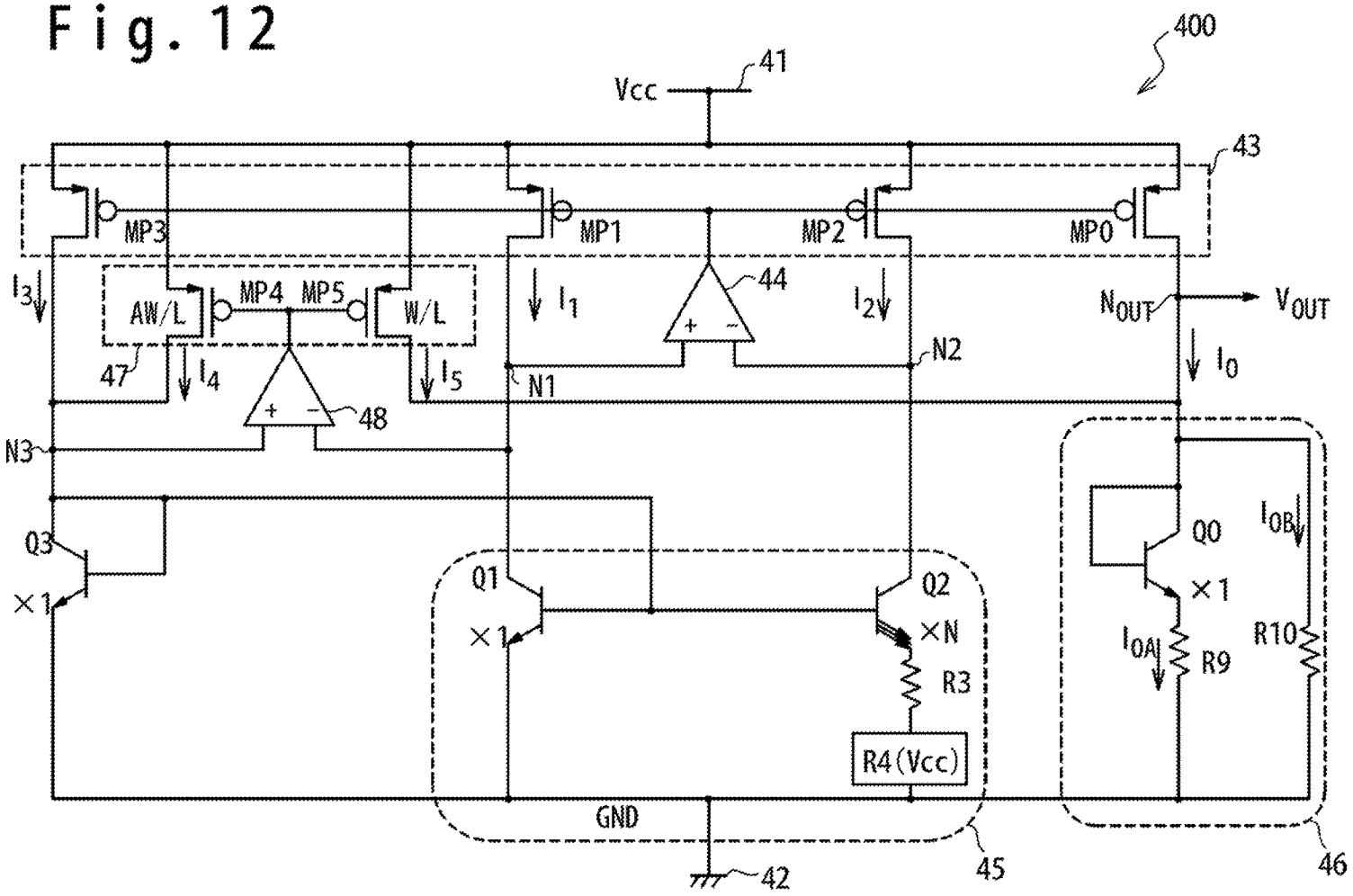

In one or more embodiments, as illustrated in FIG. 12, bandgap reference circuitry 400 comprises a power supply line 41, a ground line 42, a first current mirror 43, a first operational amplifier 44, a resistor element R3, a variable resistor element R4, bipolar transistors Q1, Q2, Q3, current-voltage converter circuitry 46, a second current mirror 47, and a second operational amplifier 48. In one embodiment, thee power supply line 41 is supplied with the power supply voltage Vcc, and the ground line 42 is grounded.

In one or more embodiments, the first current mirror 43 is configured to output first and second currents $I_1$ and $I_2$, third current $I_0$, and the fourth current $I_3$. The currents $I_0$, $I_2$ and $I_3$ may have the same current level. In one or more embodiments, the first current mirror 43 comprises PMOS transistors MP0, MP1, MP2 and MP3. The PMOS transistors MP0, MP1, MP2 and MP3 may have commonly-connected gates, and the sources thereof may be commonly connected to the power supply line 41. Further, the drains of the PMOS transistors MP1, MP2 and MP3 may be connected to the nodes N1, N2 and N3, respectively, and the drain of the PMOS transistor MP0 may be connected to the output node Nout.

In one or more embodiments, the bipolar transistors Q1, Q2 and Q3 operates as first, second and third pn junction elements, respectively, each incorporating a pn junction. In one or more embodiments, NPN transistors are used as the bipolar transistors Q1, Q2 and Q3. The bases of the bipolar transistors Q1, Q2 and Q3 may be commonly connected to the collector of the bipolar transistor Q3. The collectors of the bipolar transistors Q1, Q2 and Q3 may be connected to the first, second and third nodes N1, N2 and N3, respectively. The emitters of the bipolar transistors Q1 and Q3 may be connected to the ground line 42, and the emitter of the bipolar transistor Q2 may be connected to the ground line 42 via the resistor element R3 and the variable resistor element R4. The second and fourth currents $I_1$, $I_2$ and $I_3$ may flow through the base-emitter pn junctions of the bipolar transistors Q1, Q2 and Q3, respectively, in the forward directions.

In one or more embodiments, the base-emitter junctions of the bipolar transistors Q1 and Q3 have the same area, and the area of the base-emitter junction of the bipolar transistor Q2 is N times as large as that of the base-emitter junctions of the bipolar transistors Q1 and Q3, where N is an number larger than 1.

In various embodiments, the first operational amplifier 44 has a first input connected to the first node N1, a second input connected to the second node N2, and an output connected to the gates of the PMOS transistors MP0, MP1, MP2 and MP3. Further, the first operational amplifier 44 may be configured to output a control voltage to the gates of the PMOS transistors MP0, MP1, MP2 and MP3 of the first current mirror 43 to control the currents $I_0$, $I_1$, $I_2$ and $I_3$. In various embodiments, the operational amplifier 44 controls the potential of the gates of the PMOS transistors MP0, MP1, MP2 and MP3 so that the first and second nodes N1 and N2 have the same potential. The first and second nodes N1 and N2 may be virtually-shorted through the above operation of the first operational amplifier 44. In one or more embodiments, the first current mirror and the operational amplifier 44 operate together as current supplier circuitry configured to control the nodes N1 and N2 to the same potential and supply currents of the same current level to the nodes N1 and N2.

The current-voltage converter circuitry 46 may generate an output voltage Vout in response to the third current $I_0$ received from the first current mirror 43. In one or more embodiments, the current-voltage converter circuitry 46 comprises a diode-connected bipolar transistor Q0 and resistor elements R9 and R10. The base-emitter junction of the bipolar transistor Q0 may have the same area as that of the base-emitter junctions of the bipolar transistors Q1 and Q3. The bipolar transistor Q0 and the resistor element R9 may be connected in series between the output node Nout and the ground line 42. In one or more embodiments, the positions of the bipolar transistor Q0 and the resistor element R9 are interchangeable. Further, the resistor element R10 may be connected between the output node Nout and the ground line 42 in parallel to the bipolar transistor Q0 and the resistor element R9.

In one or more embodiments, the second current mirror 47 is configured to output a fifth current $I_4$ to the third node N3 and output a sixth current $I_5$ to the current-voltage converter circuitry 46. The current-voltage converter circuitry 46 may receive the sum current of the third current $I_0$ from the first current mirror 43 and the sixth current $I_5$ from the second current mirror 47. The mirror ratio of the second current mirror 47 may be A:1, and accordingly the current level of the sixth current $I_5$ may be 1/A as large as that of the fifth current $I_4$. In one or more embodiments, the second current mirror 47 comprises PMOS transistors MP4 and MP5. The PMOS transistors MP4 and MP5 may have commonly-connected gates, and the sources thereof may be commonly connected to the power supply line 41. The drain of the PMOS transistor MP4 may be connected to the node N3, and the drain of the PMOS transistor MP5 may be connected to the current-voltage converter circuitry 46. In one or more embodiments, the PMOS transistors MP4 and MP5 are designed so that the PMOS transistors MP4 and MP5 has the same gate length L while the gate width $W_{MP4}$ of the PMOS transistor MP4 is A times as large as the gate width $W_{MP5}$ of the PMOS transistor MP5.

In one or more embodiments, the second operational amplifier 48 outputs a control voltage to the gates of the PMOS transistors MP4 and MP5 of the second current mirror 47 to control the fifth and sixth currents $I_4$ and $I_5$. The second operational amplifier 48 may be configured to control the potential of the PMOS transistors MP4 and MP5 so that the second and third nodes N2 and N3 have the same potential. The second and third nodes N2 and N3 may be virtually-shorted by the second operational amplifier 48.

In one or more embodiments, the bandgap reference circuitry 400 illustrated in FIG. 12 is configured to output the output voltage Vout through the operation described in the following.

In various embodiments, as the first, second and fourth currents $I_1$, $I_2$ and $I_3$ are supplied to the bipolar transistors Q1, Q2 and Q3 as the collector currents while the first, second and fourth currents $I_1$, $I_2$ and $I_3$ are controlled to have the same current level, the fifth current $I_4$, which is supplied from the second current mirror 47 to the third node N3, is the sum current of the base currents of the bipolar transistors Q1, Q2 and Q3. Accordingly, the sixth current $I_5$, which is supplied to the current-voltage converter circuitry 46 from the second current mirror 47, is dependent on the base currents of the bipolar transistors Q1, Q2 and Q3.

In one embodiment, the base current of an emitter-grounded bipolar transistor is much smaller than the collector current, and therefore the current $I_4$, which is the sum current of the base currents of the bipolar transistors Q1, Q2 and Q3, can be considered as being much smaller than the currents $I_1$, $I_2$ and $I_3$, which are the collector currents of the bipolar transistors Q1, Q2 and Q3. Further, the current $I_5$ can be considered as being much smaller than the current $I_0$, because the current level of the current $I_0$ is equal to that of the currents $I_1$, $I_2$ and $I_3$ and the current $I_5$ is 1/A times as large as the current $I_4$.

In such an embodiment, to a first approximation, the output voltage Vout of the bandgap reference circuitry 400 may be represented for example by the above-described expression (21) as is the case with the bandgap reference circuitry 300 illustrated in FIG. 9. Accordingly, the temperature dependence of the output voltage Vout can be effectively reduced by appropriately adjusting N, R3, R4(Vcc) and R9. Additionally, in one or more embodiments, the dependence of the output voltage Vout on the power supply voltage Vcc can be also reduced by appropriately selecting the property of the variable resistor element R4 in accordance with the dependence of the output voltage Vout on the power supply voltage Vcc in an embodiment where the variable resistor element R4 is not provided.

The current $I_5$, which is supplied to the current-voltage converter circuitry 46 from the current mirror 47, may be used to compensate the non-linear temperature dependence of the output voltage Vout. As is understood from expression (21), the output voltage Vout is dependent on the base-emitter voltage $V_{BE0}$. It is generally known that the base-emitter voltage of a bipolar transistor has non-linear negative temperature dependence. Meanwhile, the thermal voltage Vt is proportional to the absolute temperature T, having a linear temperature dependence. Accordingly, In one or more embodiments, the non-linear temperature dependence of the output voltage Vout is not fully cancelled when only the current $I_0$ is supplied to the current-voltage converter circuitry 46. The current $I_5$ has a current level proportional to the current level of the base currents of the bipolar transistors Q1, Q2 and Q3, and therefore exhibits a non-linear temperature dependence. The bandgap reference circuitry illustrated in FIG. 12 may further reduce the temperature dependence of the output voltage Vout by supplying the current $I_5$ to the current-voltage converter circuitry 46 in addition to the current $I_0$ for compensation of the non-linear temperature dependence of the base-emitter voltage $V_{BE0}$.

Figure 13:
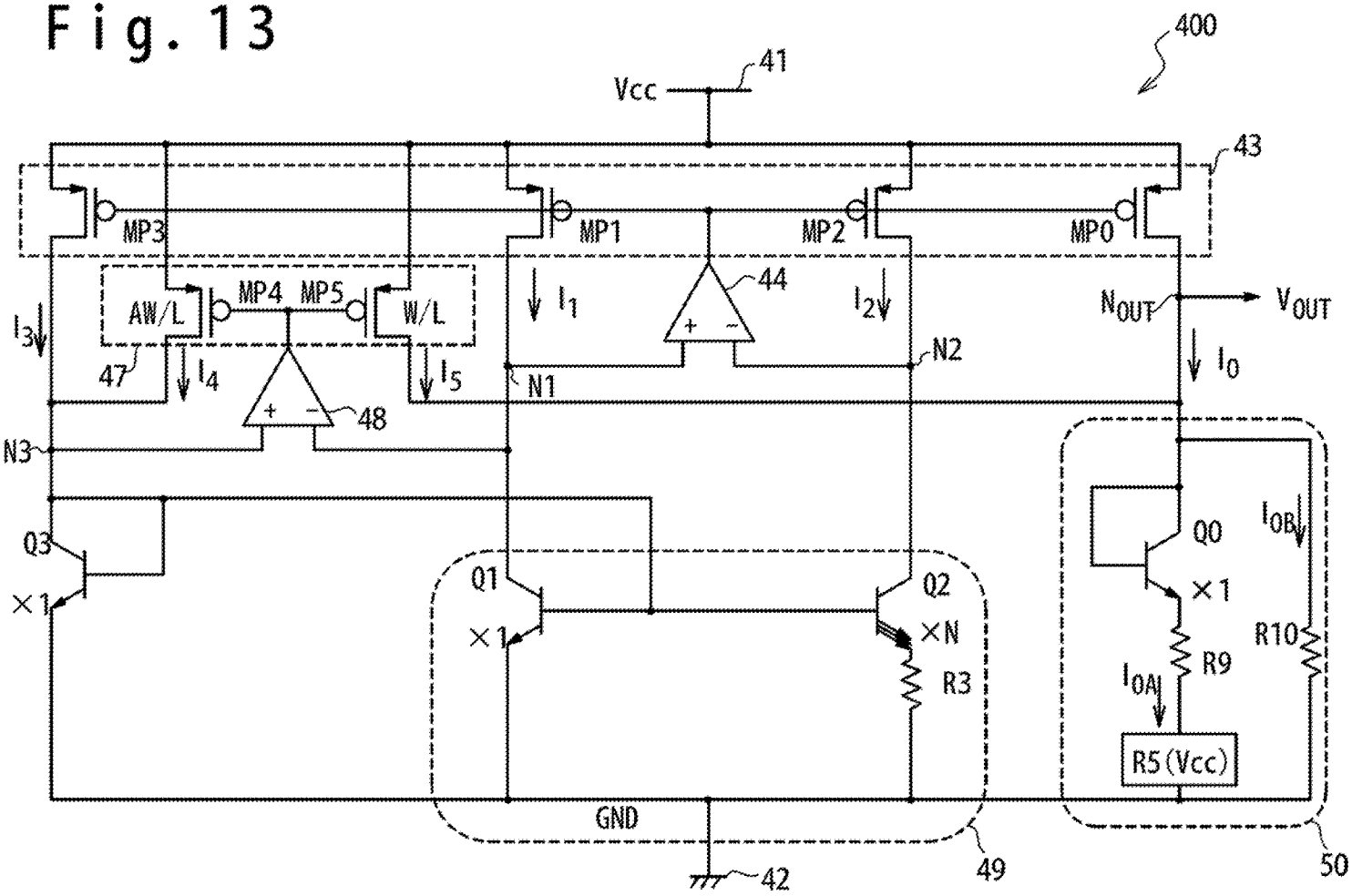

In one or more embodiments, as illustrated in FIG. 13, bandgap reference circuitry 400 is configured similarly to that illustrated in FIG. 12, except that the PTAT current generator circuitry 49 does not incorporate the variable resistor element R4 and that current-voltage converter circuitry 50 is used, in which a variable resistor element R5 is connected in series to the bipolar transistor Q0 and the resistor element R9. In one or more embodiments, the order in which the bipolar transistor Q0, the resistor element R9 and the variable resistor element R5 are connected is interchangeable.

The discussion with respect to the bandgap reference circuitry 400 illustrated in FIG. 12 may also be applicable to the bandgap reference circuitry 400 illustrated in FIG. 13. To a first approximation, the output voltage Vout of the bandgap reference circuitry 400 illustrated in FIG. 13 may be represented, for example, by the above-described expression (25), as is the case with the bandgap reference circuitry 300 illustrated in FIG. 10. Accordingly, in one or more embodiments, the temperature dependence of the output voltage Vout can be effectively reduced by appropriately adjusting N, R3, R9 and R5(Vcc). Additionally, the dependence of the output voltage Vout on the power supply voltage Vcc can be also reduced by appropriately selecting the property of the variable resistor element R5 in accordance with the dependence of the output voltage Vout on the power supply voltage Vcc in an embodiment where the variable resistor element R5 is not provided.

Figure 14:
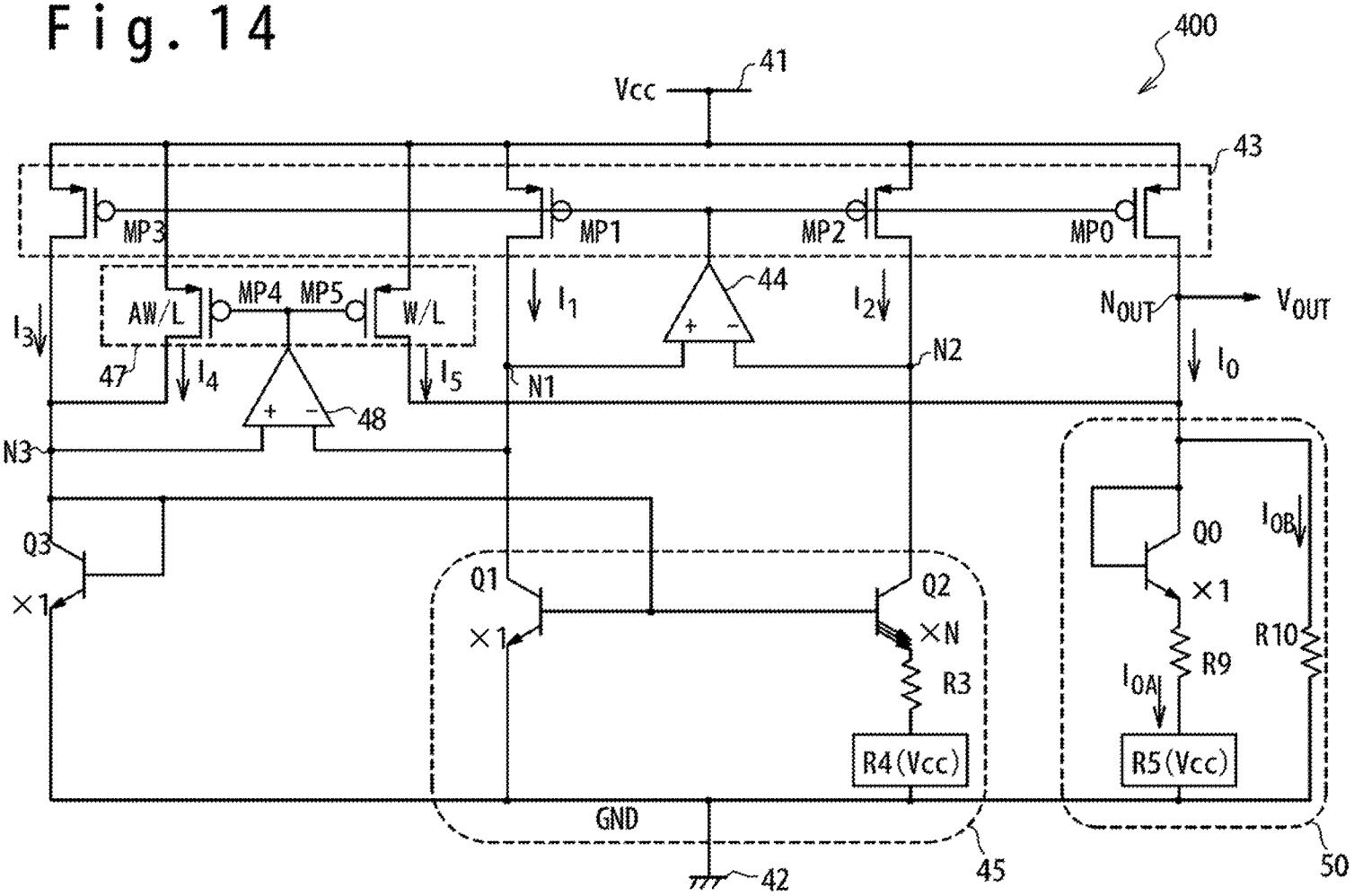

In one or more embodiments, as illustrated in FIG. 14, bandgap reference circuitry 400 is configured as a combination of the configuration illustrated in FIG. 12 and that illustrated in FIG. 13. In the configuration illustrated in FIG. 14, the PTAT current generator circuitry 45 incorporates a resistor element R4. Additionally, the current-voltage converter circuitry 50 is used, in which the variable resistor element R5 is connected in series to the bipolar transistor Q0 and the resistor element R9.

The discussions with respect to the bandgap reference circuitry 400 illustrated in FIGS. 12 and 13 may also be applicable to that illustrated in FIG. 14. To a first approximation, the output voltage Vout of the bandgap reference circuitry 400 illustrated in Fig. may be represented, for example, by the above-described expression (26), as is the case with the bandgap reference circuitry 300 illustrated in FIG. 11. In one or more embodiments, N, R3, R4(Vcc), R5(Vcc) and R9 are adjusted to make the generated output voltage Vout less dependent on the temperature or free from the temperature dependence, on the basis of expression (26). Additionally, the properties of the variable resistor elements R4 and R5 are selected so as to reduce the dependence of the output voltage Vout on the power supply voltage Vcc, in accordance with the dependence of the output voltage Vout on the power supply voltage Vcc for the case where the variable resistor elements R4 and R5 are not provided.

In one embodiment, a method for operating bandgap reference circuitry comprises supplying a first current to a first node via a current mirror connected to a power supply line. Further, a second current is supplied to a second node virtually-shorted to the first node by the current mirror. The method further comprises letting the first current flow from the first node to a ground line through a first pn junction element.

Additionally, the method comprises letting the second current flow from the second node to the ground line through a second pn junction element and a variable resistor element. The variable resistor element is configured to have a resistance dependent on a power supply voltage supplied to the power supply line.

Although various embodiments of the present disclosure have been specifically described in the above, a person skilled in the art would appreciate that the techniques disclosed in this disclosure may be implemented with various modifications.

What is claimed is:

1. Bandgap reference circuitry, comprising:

a first current mirror connected to a power supply line and configured to:

supply a first current to a first node; and supply a second current to a second node virtually-shorted to the first node;

a first pn junction element between the first node and a ground line;

a first variable resistor element between the second node and the ground line, the first variable resistor element having a resistance dependent on a power supply voltage supplied to the power supply line; and a second pn junction element connected in series to the first variable resistor element.

2. The bandgap reference circuitry according to claim 1, further comprising:

a first resistor element between the second node and the ground line, the first resistor element connected in series to the first variable resistor element and the second pn junction element.

3. The bandgap reference circuitry according to claim 1, further comprising:

a second variable resistor element between the second node and a first output of the first current mirror, wherein the first current mirror is configured to output the second current with the first output, and the second variable resistor element has a resistance dependent on the power supply voltage.

4. The bandgap reference circuitry according to claim 3, further comprising:

a third variable resistor element between the first node and a second output of the first current mirror, wherein the first current mirror is configured to output the first current with the second output, and the third variable resistor element has a resistance dependent on the power supply voltage.

5. The bandgap reference circuitry according to claim 1, wherein the first pn junction element comprises a first diode-connected bipolar transistor, and wherein the second pn junction element comprises a second diode-connected bipolar transistor.

6. The bandgap reference circuitry according to claim 1, further comprising current-voltage converter circuitry between an output node and the power supply line, wherein the first current mirror is configured to supply a third current to the output node, and wherein the current-voltage converter circuitry is configured to output an output voltage from the output node, the output voltage being generated from the third current.

7. The bandgap reference circuitry according to claim 6, further comprising:

a second resistor element between the first node and the ground line, wherein the second resistor element is connected in parallel to the first pn junction element; and a third resistor element between the second node and the ground line, wherein the third resistor element is connected in parallel to the second pn junction element.

8. The bandgap reference circuitry according to claim 6, wherein the current-voltage converter circuitry comprises a fourth variable resistor element between the output node and the ground line, wherein the fourth variable resistor element has a resistance dependent on the power supply voltage.

9. The bandgap reference circuitry according to claim 8, wherein the current-voltage converter circuitry further comprises:

a third pn junction element between the output node and the ground line; and a fifth resistor element connected in parallel to the third pn junction element and the fourth variable resistor element.

10. The bandgap reference circuitry according to claim 9, wherein the current-voltage converter circuitry further comprises a sixth resistor element between the output node and the ground line, and the sixth resistor element is connected in series to the third pn junction element and the fourth variable resistor element.

11. The bandgap reference circuitry according to claim 9, wherein:

the first pn junction element comprises a first bipolar transistor;

the second pn junction element comprises a second bipolar transistor;

the bandgap reference circuitry further comprises a third bipolar transistor between a third node and the ground line;

bases of the first bipolar transistor, the second bipolar transistor and the third bipolar transistor are commonly connected to a collector of the third bipolar transistor;

the first current mirror is configured to output a fourth current to the third node;

the first node, the second node, and the third node are virtually-shorted one another;

the first current flows through a collector of the first bipolar transistor;

the second current flows through a collector of the second bipolar transistor; and the fourth current flows through the collector of the third bipolar transistor.

12. The bandgap reference circuitry according to claim 11, further comprising:

a second current mirror configured to:

supply a fifth current to the third node; and supply a sixth current to the current-voltage converter circuitry;

a first operational amplifier comprising a first input connected to the first node and a second input connected to the second node, wherein the first operational amplifier is configured to:

output a first control voltage to the first current mirror to control the first current, the second current, the third current, and the fourth current; and a second operational amplifier comprising a first input connected to the first node and a second input connected to the third node, wherein the second operational amplifier is configured to:

output a second control voltage to the second current mirror to control the fifth current and the sixth current.

13. Bandgap reference circuitry, comprising:

a first variable resistor element having a resistance dependent on a power supply voltage supplied to a power supply line;

a current mirror connected to the power supply line, the current mirror configured to:

supply a first current to a first node; and supply a second current to a second node virtually-shorted to the first node via the first variable resistor element;

a first pn junction element connected between the first node and a ground line;

a second pn junction element connected between the second node and the ground line; and a first resistor element connected in series to the second pn junction element.

14. The bandgap reference circuitry according to claim 13, further comprising:

a second variable resistor element having a resistance dependent on the power supply voltage, wherein the current mirror is further configured to supply the first current to the first node via the second variable resistor element.

15. The bandgap reference circuitry according to claim 13, further comprising:

a second resistor element between the current mirror and the second node, wherein the second resistor element is connected in series to the first variable resistor element, wherein the current mirror is further configured to supply the second current to the second node via the first variable resistor element and the second resistor element.

16. The bandgap reference circuitry according to claim 14, further comprising:

a second resistor element between the current mirror and the second node, wherein the second resistor element is connected in series to the first variable resistor element; and a third resistor element between the current mirror and the first node, wherein the third resistor element is connected in series to the second variable resistor element, wherein the current mirror is further configured to:

supply the second current to the second node via the first variable resistor element and the second resistor element; and supply the first current to the first node via the second variable resistor element and the third resistor element.

17. Bandgap reference circuitry, comprising:

a current mirror connected to a power supply line, the current mirror configured to:

supply a first current to a first node;

supply a second current to a second node virtually-shorted to the first node; and supply a third current to an output node;

a first pn junction element between the first node and a ground line;

a second pn junction element between the second node and the ground line;

a first resistor element connected in series to the second pn junction element; and a current-voltage converter circuitry between the output node and the ground line, the current-voltage converter circuitry comprising a first variable resistor element having a resistance dependent on a power supply voltage supplied to the power supply line.

18. The bandgap reference circuitry according to claim 17, further comprising:

a second resistor element between the first node and the ground line, wherein the second resistor element is connected in parallel to the first pn junction element; and a third resistor element between the second node and the ground line, wherein the third resistor element is in parallel to the second pn junction element.

19. The bandgap reference circuitry according to claim 17, wherein the current-voltage converter circuitry further comprises:

a third pn junction element; and a fourth resistor element, wherein the third pn junction element and the first variable resistor element are connected in series between the output node and the ground line, and wherein the fourth resistor element is between the output node and the ground line and connected in parallel to the third pn junction element and the first variable resistor element.

20. The bandgap reference circuitry according to claim 1, wherein the first variable resistor element comprises an NMOS transistor having a gate supplied with the power supply voltage.

* * * * *